US011555594B1

(12) United States Patent
Xie

(10) Patent No.: US 11,555,594 B1
(45) Date of Patent: Jan. 17, 2023

(54) AUTOMOTIVE LED HEADLIGHT AND MANUFACTURING PROCESS

(71) Applicant: SHENZHEN AURORA TECHNOLOGY LIMITED, Shenzhen (CN)

(72) Inventor: Qingbo Xie, Shenzhen (CN)

(73) Assignee: SHENZHEN AURORA TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 17/401,363

(22) Filed: Aug. 13, 2021

(30) Foreign Application Priority Data

Jul. 14, 2021 (CN) ..... 202110795948.0

(51) Int. Cl.

| | |
|---|---|
| ***F21S 45/48*** | (2018.01) |
| ***F21V 23/00*** | (2015.01) |
| ***F21V 31/00*** | (2006.01) |
| ***F21V 21/08*** | (2006.01) |
| ***F21V 23/06*** | (2006.01) |
| *F21Y 115/10* | (2016.01) |

(52) U.S. Cl.
CPC ..... *F21S 45/48* (2018.01); *F21V 21/0816* (2013.01); *F21V 23/004* (2013.01); *F21V 23/06* (2013.01); *F21V 31/005* (2013.01); *F21Y 2115/10* (2016.08)

(58) Field of Classification Search
CPC .... F21S 45/48; F21V 21/0816; F21V 23/004; F21V 23/06; F21V 31/005; F21Y 2115/10
See application file for complete search history.

(56) References Cited

U.S. PATENT DOCUMENTS

2015/0285471 A1* 10/2015 Shih ..... F21V 19/0035 362/249.01

FOREIGN PATENT DOCUMENTS

CN 109654452 A * 4/2019

* cited by examiner

*Primary Examiner* — Anabel Ton

(57) ABSTRACT

The present disclosure discloses an automotive LED headlight and manufacturing process. The automotive LED headlight includes a radiator integrally formed and a PCBA board, wherein a hole is arranged in the center of the radiator and used for accommodating an end portion of the PCBA board, and the end portion of the PCBA board is tightly connected with the radiator. The present disclosure has the advantages of good heat dissipation effect, simple processing technology, and low material and manufacturing costs.

11 Claims, 7 Drawing Sheets

AUTOMOTIVE LED HEADLIGHT AND MANUFACTURING PROCESS

TECHNICAL FIELD

The present disclosure relates to the field of automotive accessories, and more particularly to an automotive LED headlight and a manufacturing process.

BACKGROUND

As LED headlights are applied in automobiles more widely, the industry competition is becoming increasingly fierce. Only by developing higher-quality and cheaper products, can a company stand out from the industry competition. A base of an LED automotive headlight is the key to heat dissipation of the headlight, and the heat dissipation effect directly affects the life of the LED automotive headlight.

A heat-dissipating base of an existing LED automobile headlight has a high manufacturing cost, requires complicated processes such as machining processes, and requires professional operations, which increases the material and labor costs of the headlight.

The base of the existing LED automotive headlight is generally a split-type heat-dissipating structure that is combined by an upper base member and a lower base member, and an LED lamp bead plate is arranged between the two base members and fixed through screws, which causes poor dissipation efficiency and effect.

SUMMARY

To overcome the disadvantages of the prior art, the present disclosure provides an automotive LED headlight and a manufacturing process, which has the advantages of good heat dissipation effect, simple processing technology, and low material and manufacturing costs. The present disclosure is achieved by the following technical solutions.

An automotive LED headlight, comprising a radiator formed integrally and a PCBA board, wherein a hole is arranged in the center of the radiator and used for accommodating an end portion of the PCBA board, and the end portion of the PCBA board is tightly connected with the radiator.

A manufacturing process of automotive LED headlight comprises the following steps:

a material is first extruded to form a radiator, then cut and next surface-treated, leaving a hole in the radiator, wherein the material of the radiator is made of an integrally formed aluminum or other metal materials with good thermal conductivity; and a PCBA board is directly inserted into the integrally formed radiator through the hole to reach the bottom and riveted together by a riveting machine, thus the PCBA board is closely attached to the radiator.

The beneficial effects of the present invention are as follow:

1. The PCBA board is closely attached to the radiator, so that the gap is smaller, the air circulation is less, and the heat conduction is better. The heat emitted by the LED lamp bead is directly transferred to the radiator through the PCBA board, and then to outside from the radiator, which can reduce the heat switching times between different media and structures, thus to improve the heat conduction efficiency and to further ensure the heat dissipation effect.

2. The material is extruded to form the radiator, without going through complicated processes such as CNC, thus the process is simple, the material is less, and the cost is saved.

3. The new radiator is made by less material, only one third of the material of the traditional radiator, which can save materials, costs and resources.

Figure 1:
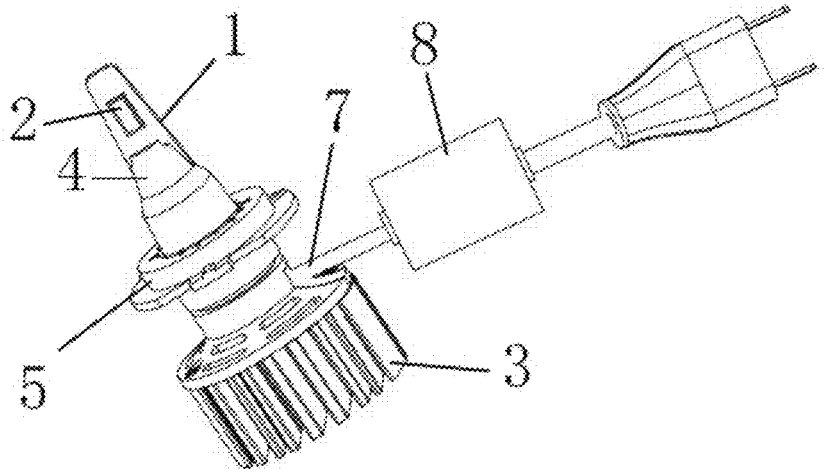
FIG. 1 is a schematic structural view of an automotive LED headlight according to Embodiment 1 of the present disclosure.

The reference numerals in drawings are shown as below: PCBA board 1, LED lamp bead 2, radiator 3, inner ring 4, buckle 5, waterproof sealing ring 6, power connector 7, external drive 8, tail cap 9, fan 10, screw 11, internal drive 12, decorative sleeve 13.

DETAILED DESCRIPTION OF PREFERRED EMBODIMENTS

The technical solutions in the embodiments of the present disclosure will be clearly and completely described hereafter in conjunction with the accompanying drawings in the embodiments of the present disclosure. Obviously, the described embodiments are merely a part of the embodiments of the present disclosure, rather than all the embodiments. Based on the embodiments of the present disclosure, all other embodiments obtained by those of ordinary skill in the art without creative work shall fall within the protection scope of the present disclosure.

As shown in FIGS. 1-13, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 6.

The PCBA board 1 is a double-sided PCB board suitable for installing an LED lamp bead 2 on both sides, and a substrate of the PCB board includes a copper plate, an aluminum plate or a composite substrate with a thickness of 0.1 to 3 mm.

In the embodiment of the present disclosure, the automotive LED headlight further includes an inner ring 4 used for fixing the radiator 3 and protecting the PCBA board 1, and the material of the inner ring 4 includes plastic or metal material.

In the embodiment of the present disclosure, the automotive LED headlight further includes a buckle 5 fixed on the inner ring 4 and used for receiving automotive accessories.

A waterproof sealing ring 6 is arranged between the buckle 5 and the inner ring 4, so that the assembled automotive LED headlight has a waterproof function.

The inner ring 4 is fixedly connected with the radiator 3 by screws 11, and the inner ring 4 is fixed with the PCBA board 1 through the buckle 5, so that the PCBA board 1 passes through the inner ring 4 and is fixed with the radiator 3 to complete the assembly.

A power cord passes through the inner ring 4 through a power connector 7 and is electrically connected with the PCBA board 1.

Figure 14:
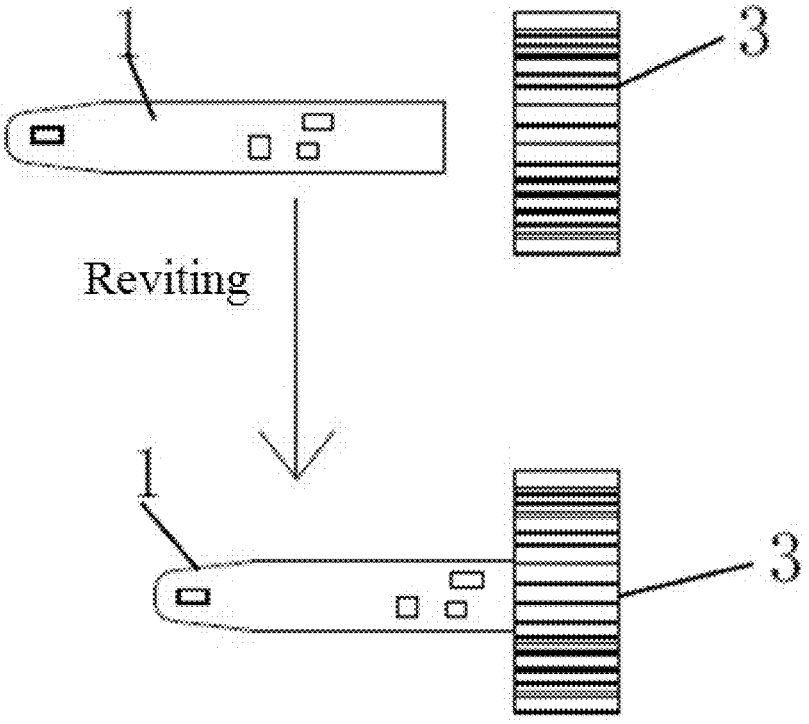
FIG. 14 is a schematic view of a manufacturing process according the present disclosure.

As shown in FIG. 14, a manufacturing process of an automotive LED headlight includes the following steps:

material of a radiator is made of an integrally formed aluminum or other metal materials with good thermal conductivity; the material is first extruded to form a radiator, then cut and next surface-treated, leaving a hole in the radiator; and the PCBA board is directly inserted into the integrally formed radiator through the hole to reach the bottom and riveted together by a riveting machine, thus the PCBA board is closely attached to the radiator.

The hole has a shape conforms to that of the PCBA board 1, so that they are combined and assembled tightly. The PCBA board 1 is closely attached to the radiator 3, so that the gap is smaller, the air circulation is less, and the heat conduction is better. The heat emitted by the LED lamp bead is directly transferred to the radiator 3 through the PCBA board 1, and then to outside from the radiator 3, which can reduce the heat switching times between different media and structures, thus to improve the heat conduction efficiency and to further ensure the heat dissipation effect.

Embodiment 1

Figure 2:
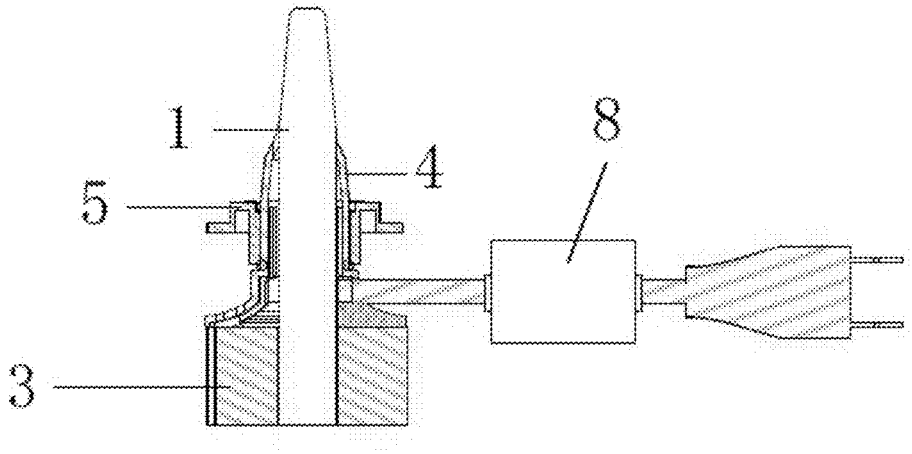
FIG. 2 is a cross-sectional structural view of FIG. 1.
Figure 3:
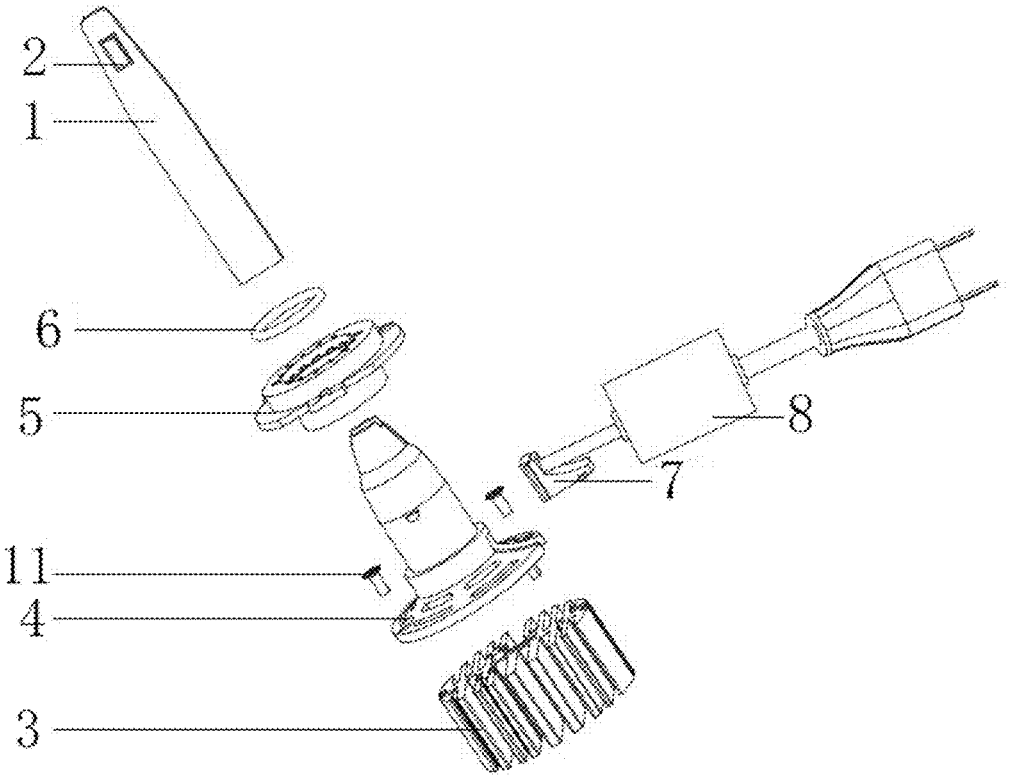
FIG. 3 is an exploded structural view of FIG. 1.

As shown in FIGS. 1-3, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 3.

The automotive LED headlight also includes an inner ring 4 used for fixing the radiator 3 and protecting the PCBA board 1, and the material of the inner ring 4 includes plastic or metal material. The automotive LED headlight further includes a buckle 5 fixed on the inner ring 4 and used for receiving automotive accessories, and a waterproof sealing ring 6 is arranged between the buckle 5 and the inner ring 4, so that the assembled automotive LED headlight has a waterproof function.

In this embodiment, an external drive mode is applied to the automotive LED headlight, and an external drive 8 is located on a connecting wire.

Embodiment 2

Figure 4:
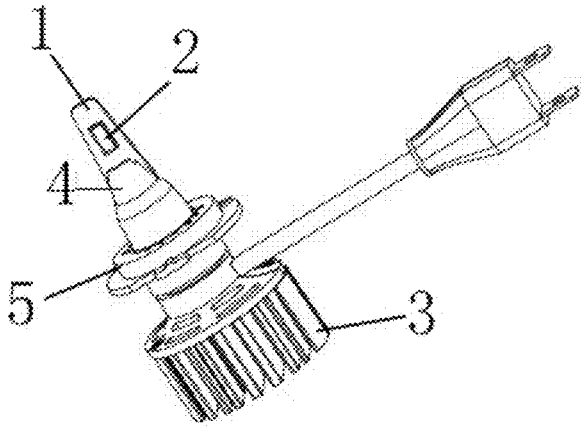
FIG. 4 is a schematic structural view of an automotive LED headlight according to Embodiment 2 of the present disclosure.
Figure 5:
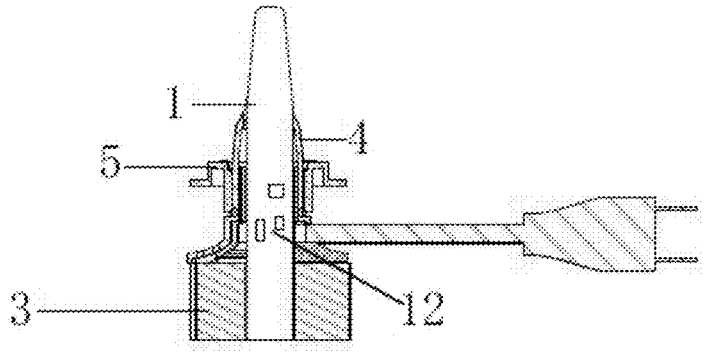
FIG. 5 is a cross-sectional structural view of FIG. 4.

As shown in FIGS. 4-5, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 3.

The automotive LED headlight also includes an inner ring 4 used for fixing the radiator 3 and protecting the PCBA board 1, and the material of the inner ring 4 includes plastic or metal material. The automotive LED headlight further includes a buckle 5 fixed on the inner ring 4 and used for receiving automotive accessories.

In this embodiment, an internal drive mode is applied to the automotive LED headlight, and an internal drive 12 is located at a component area on the PCBA board 1 and electrically connected to an LED lamp bead 2.

Embodiment 3

Figure 6:
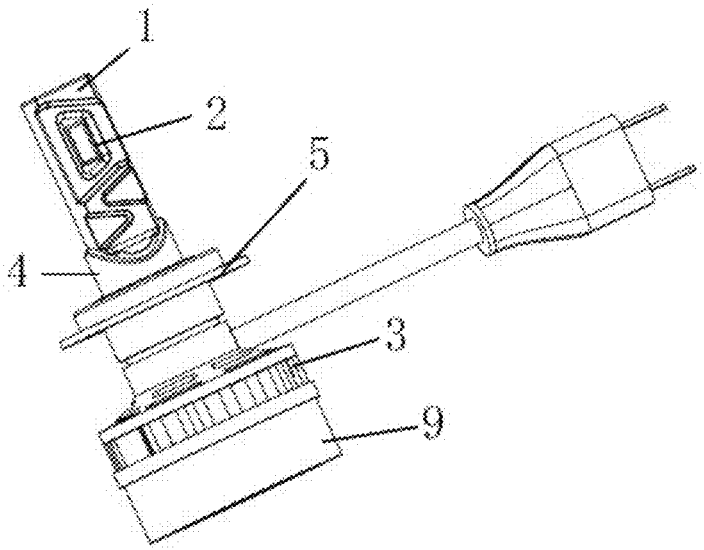
FIG. 6 is a schematic structural view of an automotive LED headlight according to Embodiment 3 of the present disclosure.
Figure 7:
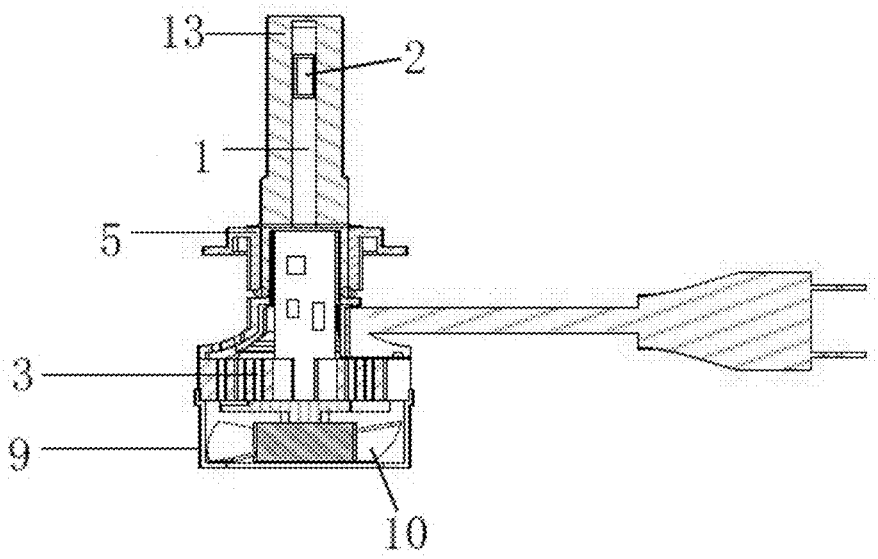
FIG. 7 is a cross-sectional structural view of FIG. 6.

As shown in FIGS. 6-7, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 3.

The automotive LED headlight also includes an inner ring 4 used for fixing the radiator 3 and protecting the PCBA board 1, and the material of the inner ring 4 includes plastic or metal material. The automotive LED headlight further includes a buckle 5 fixed on the inner ring 4 and used for receiving automotive accessories.

In this embodiment, a decorative sleeve 13 is also embedded and sleeved on an exposed part of the PCBA board 1, which provides a decorative effect as well as a protective effect.

In the embodiment, an internal drive mode is applied to the automotive LED headlight, and an internal drive 12 is located at a component area on the PCBA board 1 and electrically connected to an LED lamp bead 2.

In the embodiment, an end portion of the radiator 3 is provided with a fan 10 and a tail cap 9. The fan 10 is fixed on the end portion of the radiator 3 to enhance heat dissipation, the tail cap 9 covers and protects the fan 10, and a plurality of vent holes are provided on the tail cap 9.

Embodiment 4

Figure 8:
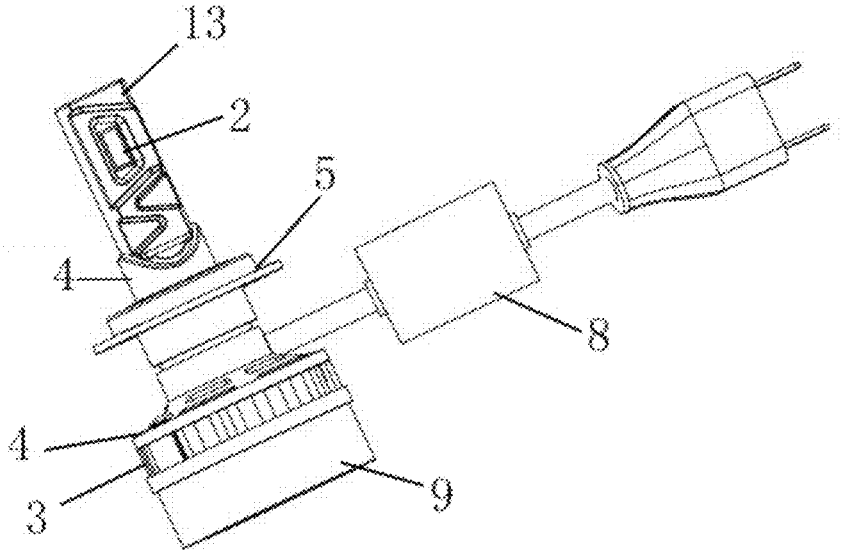
FIG. 8 is a schematic structural view of an automotive LED headlight according to Embodiment 4 of the present disclosure.
Figure 9:
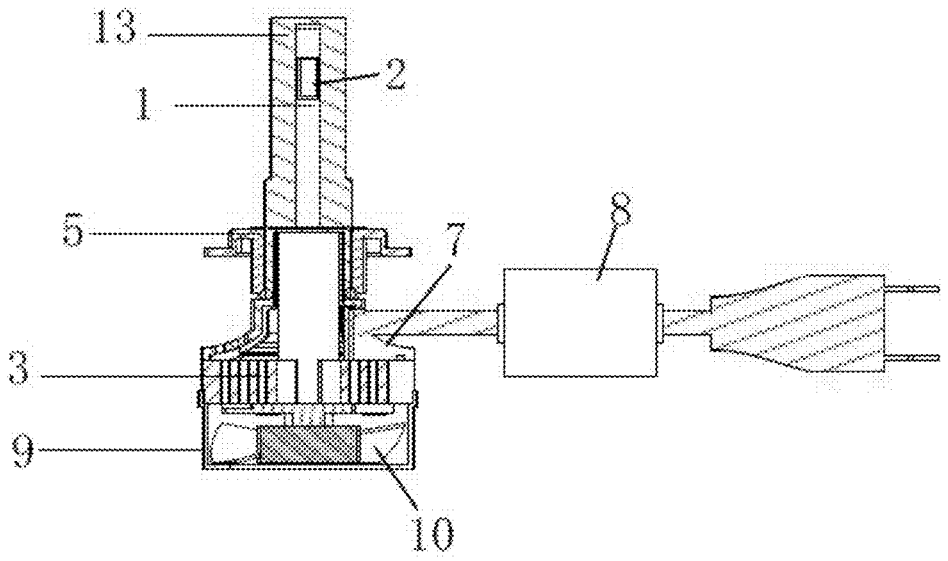
FIG. 9 is a cross-sectional structural view of FIG. 8.

As shown in FIGS. 8-9, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 3.

The automotive LED headlight also includes an inner ring 4 used for fixing the radiator 3 and protecting the PCBA board 1, and the material of the inner ring 4 includes plastic or metal material. The automotive LED headlight further includes a buckle 5 fixed on the inner ring 4 and used for receiving automotive accessories.

In this embodiment, a decorative sleeve 13 is also embedded and sleeved on an exposed part of the PCBA board 1, which provides a decorative effect as well as a protective effect.

In the embodiment, an external drive mode is applied to the automotive LED headlight, and an external drive 8 is located on a connecting wire.

In the embodiment, an end portion of the radiator 3 is provided with a fan 10 and a tail cap 9. The fan 10 is fixed at the end portion of the radiator 3 to enhance heat dissipation, the tail cap 9 covers and protects the fan 10, and a plurality of vent holes are provided on the tail cap 9.

Embodiment 5

Figure 10:
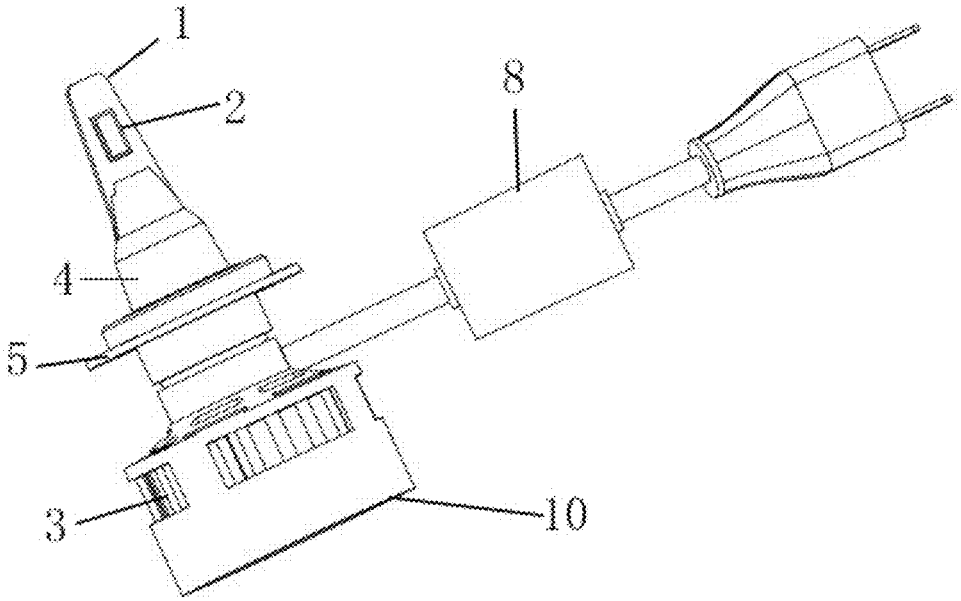
FIG. 10 is a schematic structural view of an automotive LED headlight according to Embodiment 5 of the present disclosure.
Figure 11:
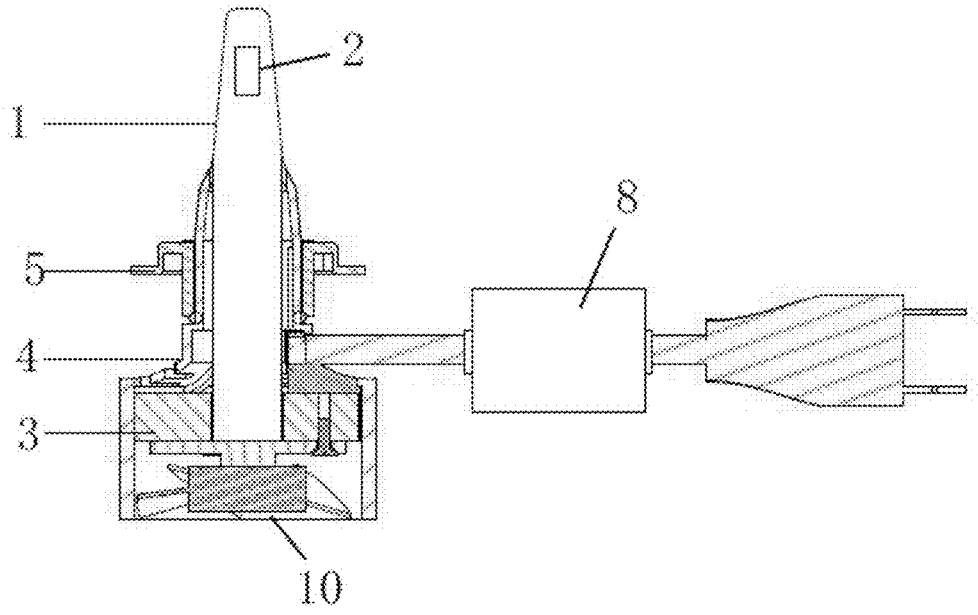
FIG. 11 is a cross-sectional structural view of FIG. 10.

As shown in FIGS. 10-11, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 3.

The automotive LED headlight also includes an inner ring 4 used for fixing the radiator 3 and protecting the PCBA board 1, and the material of the inner ring 4 includes plastic or metal material. The automotive LED headlight further includes a buckle 5 fixed on the inner ring 4 and used for receiving automotive accessories.

In the embodiment, an external drive mode is applied to the automotive LED headlight, and an external drive 8 is located on a connecting wire.

In the embodiment, a fan 10 is provided and fixed on an end portion of the radiator 3 for enhancing heat dissipation.

Embodiment 6

Figure 12:
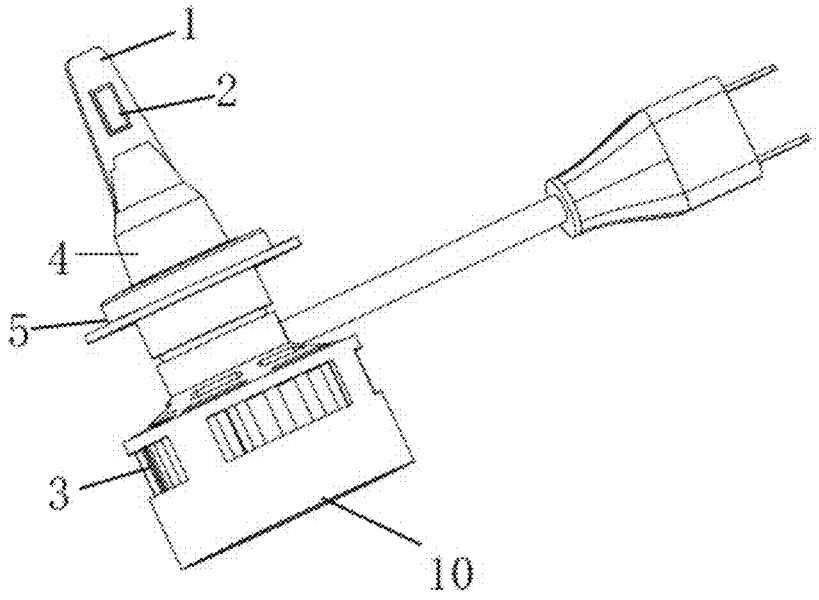
FIG. 12 is a schematic structural view of an automotive LED headlight according to Embodiment 6 of the present disclosure.
Figure 13:
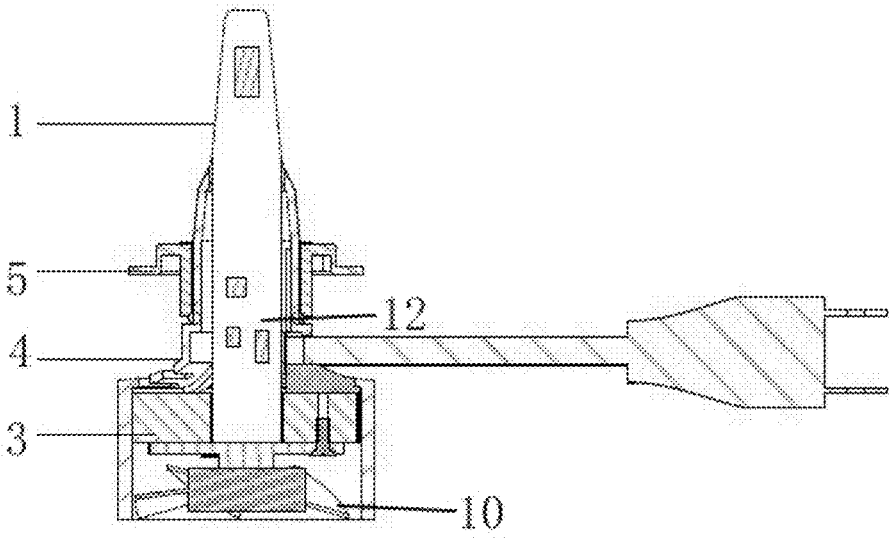
FIG. 13 is a cross-sectional structural view of FIG. 12.

As shown in FIGS. 12-13, an automotive LED headlight comprises a PCBA board 1, and a radiator 3 that is made of integrally formed aluminum or other metal materials with good thermal conductivity. The radiator 3 is provided with a hole preferably located in the center of the radiator 3, and the hole penetrates the radiator 3. The hole is used to accommodate an end portion of the PCBA board 1, and the end portion of the PCBA board 1 is tightly connected with the radiator 3.

The automotive LED headlight also includes an inner ring 4 used for fixing the radiator 3 and protecting the PCBA board 1, and the material of the inner ring 4 includes plastic or metal material. The automotive LED headlight further includes a buckle 5 fixed on the inner ring 4 and used for receiving automotive accessories.

In the embodiment, an internal drive mode is applied to the automotive LED headlight, and an internal drive 12 is located at a component area on the PCBA board 1 and electrically connected to an LED lamp bead 2.

In the embodiment, a fan 10 is provided and fixed on an end portion of the radiator 3 for enhancing heat dissipation.

In other embodiments of the present disclosure, the inner ring can also be made of various materials and configured as various shapes, and can be covered by various personalized styles of decorative protective caps. As shown in Embodiment 4, the inner ring 4 can be connected with the tail cap 9 together. As shown in Embodiment 1, when the fan 10 is not needed, the tail cap 9 is directly removed.

In other embodiments of the present disclosure, the inner ring, the fan, the tail cap, the decorative sleeve, and the power connector can all be configured as a variety of styles for customers to select. Different solutions are combined according to different needs of customers, and the modified designs based on the present disclosure are all within the protective scope of the present disclosure.

Although the embodiments of the present disclosure have been illustrated and described, those of ordinary skill in the art should understand that various changes, modifications, substitutions and variations can be made to these embodiments without departing from the principles and spirits of the present disclosure, and the scope of the present disclosure is defined by the append portioned claims and their equivalents.

What is claimed is:

1. An automotive LED headlight, comprising a radiator integrally formed and a PCBA (Printed Circuit Board Assembly) board, wherein a hole is defined in a center of the radiator and penetrates through the radiator and is used for accommodating an end portion of the PCBA board, wherein the hole has a shape that is congruent with that of the PCBA board, and wherein the end portion of the PCBA board is inserted into the integrally formed radiator through the hole to reach a bottom of the radiator and is riveted together with the radiator to be tightly connected with the radiator; wherein the PCBA board comprises a double-sided PCB board and an LED lamp bead installed on each of both sides of the double-sided PCB board; wherein a substrate of the PCB board comprises a copper plate, an aluminum plate or a composite substrate with a thickness of 0.1 to 3 mm.

2. The automotive LED headlight according to claim 1, wherein the automotive LED headlight further comprises an inner ring used for fixing the radiator and protecting the PCBA board.

3. The automotive LED headlight according to claim 2, wherein a material of the inner ring comprises a plastic or metal material.

4. The automotive LED headlight according to claim 1, wherein the automotive LED headlight further comprises a buckle fixed on the inner ring and used for receiving automotive accessories.

5. The automotive LED headlight according to claim 1, wherein the automotive LED headlight is driven under an internal drive mode or an external drive mode.

6. The automotive LED headlight according to claim 5, wherein the internal drive mode is that an LED lamp bead hoard and a drive board are integrated on the PCBA board.

7. The automotive LED headlight according to claim 5, wherein the external drive mode is that a drive board is arranged on a connecting wire and connected to the PCBA board through a connector of the connecting wire.

8. The automotive LED headlight according to claim 1, wherein the radiator is provided with a fan or with a fan and a tail cap.

9. The automotive LED headlight according to claim 2, wherein a decorative sleeve is disposed at a portion where the PCBA board is exposed from the inner ring, and the decorative sleeve is connected with an end portion of the inner ring for covering the PCBA board.

10. A manufacturing process of an automotive LED headlight, comprising:

extruding a material to form a radiator, cutting and surface-treating the radiator, leaving a hole in a center of the radiator, wherein the material of the radiator is made of an integrally formed aluminum or other thermal conductive metal materials, wherein the hole penetrates through the radiator and has a shape that is congruent with that of the PCBA board; and directly inserting a PCBA (Printed Circuit Board Assembly) board into the integrally formed radiator through the hole to reach a bottom of the radiator and riveting the PCBA board and the radiator together by a riveting machine, so that the PCBA board is closely attached to the radiator, wherein the PCBA board comprises a double-sided PCB board and an LED lamp bead installed on each of both sides of the double-sided PCB board.

11. The automotive LED headlight according to claim 1, wherein the double-sided PCB board is a single unitary flat board.

* * * * *